US005186473A

United States Patent [19]

Windges et al.

[11] Patent Number: 5,186,473

[45] Date of Patent: Feb. 16, 1993

[54] DEVICE FOR SEALING A GAP BETWEEN TWO RELATIVELY MOVING SURFACES

[75] Inventors: Bernd Windges, Mönchengladbach; Ferdinand Leifeld, Kempen, both of Fed. Rep. of Germany

[73] Assignee: Trützschler GmbH & Co. KG, Mönchengladbach, Fed. Rep. of Germany

[21] Appl. No.: 783,116

[22] Filed: Oct. 25, 1991

[30] Foreign Application Priority Data

Nov. 2, 1990 [DE] Fed. Rep. of Germany ..... 4034841

[51] Int. Cl.[5] ..... F16J 15/34

[52] U.S. Cl. ..... 277/81 R; 277/96.2; 277/DIG. 7; 19/98

[58] Field of Search ..... 277/81 R, 92, 93 R, 277/93 SD, DIG. 7, 148, 149, 96.2, 35, 40; 19/98, 102, 105, 103

[56] References Cited

U.S. PATENT DOCUMENTS

| | | | |
|---|---|---|---|
| 372,038 | 10/1887 | Mills | 19/103 |
| 410,864 | 9/1889 | Taft | 19/98 |
| 451,367 | 4/1891 | Canning | 19/103 |
| 2,220,344 | 11/1940 | McFall | 277/149 |
| 2,245,475 | 6/1941 | Hately | 277/35 X |
| 2,439,315 | 4/1948 | Newton et al. | 277/85 X |
| 2,454,036 | 11/1948 | Clayton-Wright | 277/149 |
| 3,000,846 | 9/1961 | Runton et al. | 277/96.2 X |
| 3,081,975 | 3/1963 | Sproule et al. | 277/92 X |
| 3,144,686 | 8/1964 | Aoki | 19/105 |
| 3,389,921 | 6/1968 | Lojkutz | 277/92 X |
| 3,391,964 | 7/1968 | Miyake | 277/92 X |
| 3,467,399 | 9/1969 | Kelly et al. | 277/DIG. 7 |
| 3,532,350 | 10/1970 | Kaufman | 277/92 X |
| 3,536,333 | 10/1970 | Gits et al. | 277/40 X |
| 3,573,875 | 4/1971 | Zuczek | 277/DIG. 7 X |
| 3,806,136 | 4/1974 | Warner et al. | 277/40 |
| 4,221,390 | 9/1980 | Bainbridge | 277/DIG. 7 X |
| 4,528,722 | 7/1985 | Demuth et al. | 19/98 |

FOREIGN PATENT DOCUMENTS

| | | | |
|---|---|---|---|
| 28029 | 1/1884 | Fed. Rep. of Germany | 19/103 |
| 2202986 | 1/1973 | Fed. Rep. of Germany . | |
| 390746 | 8/1965 | Switzerland . | |
| 1463746 | 2/1977 | United Kingdom . | |
| 2006845 | 5/1979 | United Kingdom . | |
| 1563924 | 4/1980 | United Kingdom . | |
| 1583220 | 1/1981 | United Kingdom . | |
| 2054769 | 2/1981 | United Kingdom . | |
| 2054770 | 2/1981 | United Kingdom . | |
| 2096247 | 10/1982 | United Kingdom . | |
| 2111142 | 6/1983 | United Kingdom . | |

*Primary Examiner*—William A. Cuchlinski, Jr.
*Assistant Examiner*—Scott W. Cummings
*Attorney, Agent, or Firm*—Spencer, Frank & Schneider

[57] ABSTRACT

A seal unit for sealing a clearance between relatively movable first and second machine components includes a low-friction, wear-resistant sealing element having a sealing face for sealingly engaging a surface of the first machine component; a spring having a soft spring characteristic and being at least indirectly in engagement with the second machine component and a reverse face of the sealing element for resiliently urging the sealing face of the sealing element against the surface of the first machine component.

11 Claims, 4 Drawing Sheets

1
2
3
4
5
6
7
8
9
10
11
12
13
14
15
16

DEVICE FOR SEALING A GAP BETWEEN TWO RELATIVELY MOVING SURFACES

BACKGROUND OF THE INVENTION

This invention relates to a device for sealing a clearance between two relatively moving surfaces, particularly a radial end face of a roll in a fiber processing machine and an adjoining stationary wall face forming part of the machine (such as a card, a roller card unit, a card feeder or a cleaner).

It is generally difficult to seal relatively movable surfaces against one another. Such is the case when a seal has to be provided between a radial end face of a rotary roll or cylinder and an adjoining wall surface. It is known, for example, to use squeegee-like devices which, however, have not proven to be satisfactory. The principal difficulty in fiber processing machines resides in the fact that air circulations in the clearance lead to undesired fiber movements. Thus, very small fiber fragments gain access to the clearance in which they may accumulate which, in the long run, leads to clogging or significant braking of the roll. For preventing fiber particles from entering into the clearance, bristle seals have been used. These, however, have also not proven successful because they were either too stiff or too loose and thus have led either to a braking of the roll accompanied by significant frictional heating or have not provided an acceptable seal at all. It is a also a disadvantage of known sealing constructions that in case of a periodic engagement of the seal, a "breathing motion" between the space to be sealed and the external environment occurs.

SUMMARY OF THE INVENTION

It is an object of the invention to provide an improved device of the above-outlined type from which the discussed disadvantages are eliminated and which, in particular, ensures a secure and operationally safe sealing of the rotating roll against the adjoining stationary lateral surfaces.

This object and others to become apparent as the specification progresses, are accomplished by the invention, according to which, briefly stated, the seal proper is a low-friction, wear-resistant material which, on its reverse side, is engaged by a soft spring element urging the sealing face of the seal towards the component to be sealed.

By pressing the low-friction and wear-resistant sealing member by a soft spring or springs against a counterface, there is advantageously achieved an operationally safe, gapless seal. The spring force urges the sealing member, for example, a sealing ring, sealingly against the counterface and the use of a soft spring element simultaneously avoids disturbing effects such as wear, frictional heat-up, braking, and the like.

Advantageously, the seal is made of a felt material It is difficult, circumstantial and thus economically not feasible to narrow and control the tolerances in machine construction in such a manner that, on the one hand, no braking occurs and, on the other hand, no air gap appears. Felt material is viewed as the ideal sealing substance from the point of view of frictional and wear behavior. Felt material is, however, rigid to a high degree if in a compressed state, and a large force is needed even if a 0.1 mm further compression is to be obtained. Since during such a compression the force increases very substantially, there will also rapidly appear a large friction force which is not desirable. Temperature-caused expansions of machine components also lead to changes of dimensions, including the sealing clearance. Such changes are advantageously absorbed by the felt material.

DESCRIPTION OF THE PREFERRED EMBODIMENTS

Figure 1:
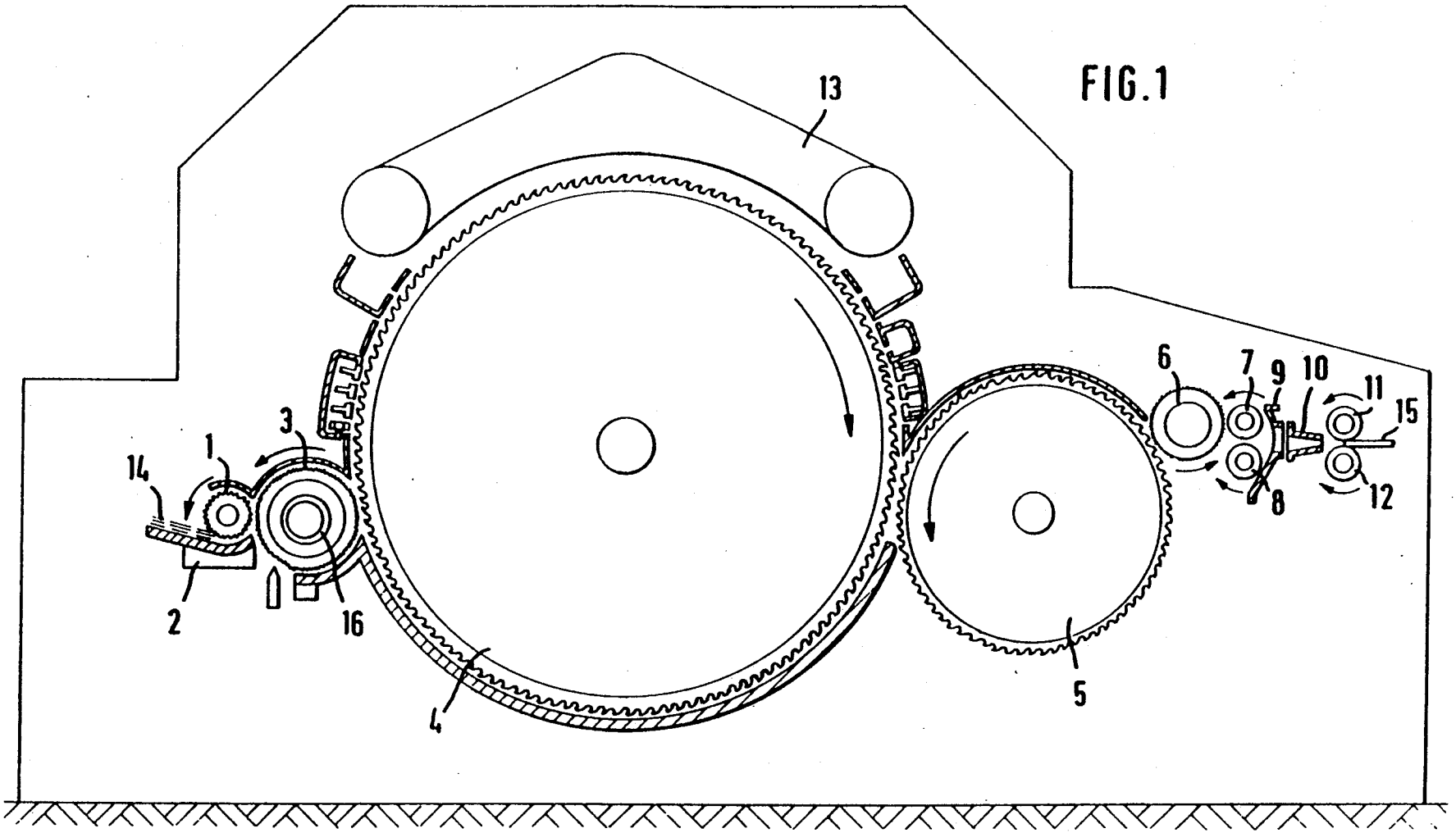
FIG. 1 is a schematic side elevational view of a carding machine incorporating the invention.

In FIG. 1 there is shown a carding machine which may be an EXACTACARD DK 740 model, manufactured by Trützschler GmbH & Co. KG, Mönchengladbach, Germany. The carding machine has a feed roll 1, a feed table 2, a licker-in 3, a main carding cylinder 4, a doffer 5, a stripping roll 6, crushing rolls 7, 8, a web guide element 9, a sliver trumpet 10, calender rolls 11 and 12 as well as travelling flats 13 cooperating with the main carding cylinder 4. The direction of rotation of the respective rotary components is designated by an arcuate arrow. The reference numeral 14 designates the fiber lap which is introduced into the carding machine at the feed roll 1 whereas reference numeral 15 designates the fiber sliver withdrawn from the trumpet 10 by the calender rolls 11, 12.

Figure 2:
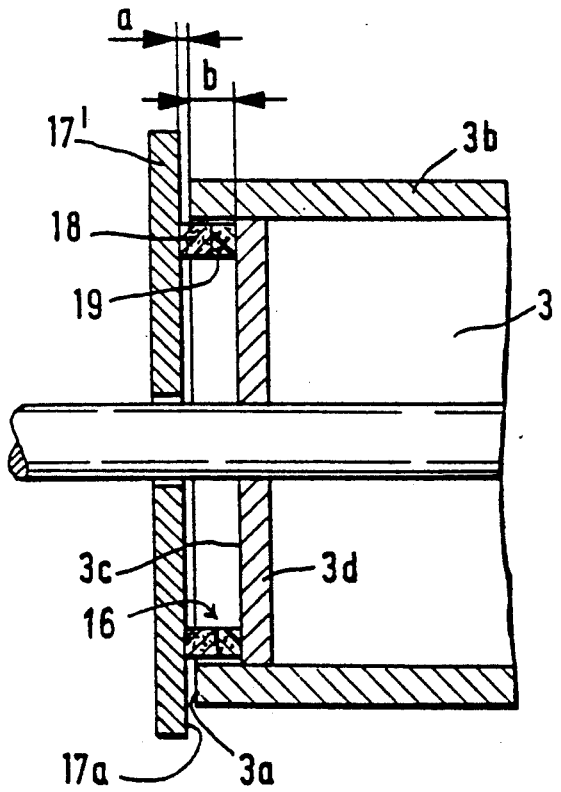
FIG. 2 is a sectional elevational view of a preferred embodiment of the invention.
Figure 2A:
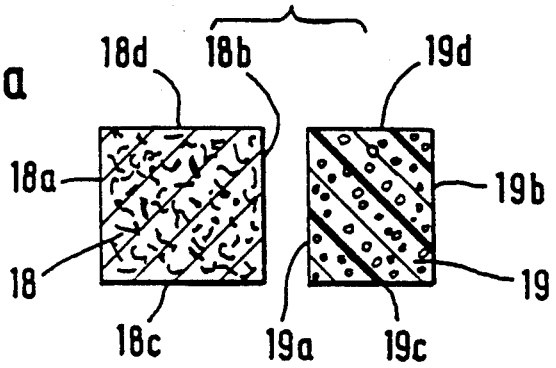
FIG. 2*a* is an exploded detail, on an enlarged scale, of the embodiment illustrated in FIG. 2.

Also referring to FIG. 2, there is shown therein one end portion of the licker-in 3 which has a cylindrical body shell 3*b* terminating in an annular edge face 3*a* which is at a narrow clearance a from the inwardly oriented surface 17*a* of a lateral stationary wall 17. The cylindrical shell 3*b* is closed by a radial bottom 3*d* which is recessed inwardly and is at a distance b from the stationary wall 17. A seal assembly 16 is supported on the outer face 3*c* of the bottom 3*d*. The sealing ring 18 is situated at an outer diametral zone of the base 3*c*. It is feasible to position the sealing ring 18 on the edge face 3*a*, that is, at an outer diametral zone of the licker-in 3.

The seal assembly 16 is formed of a sealing ring 18 made, for example, of felt and a spring ring 19 made, for example, of foam plastic. The inner radial surface 18*b* of the sealing ring 18 and the outer radial surface 19*a* of the spring ring 19 are firmly bonded (for example, glued) to one another. The outer radial surface 18*a* of the sealing ring 18 is in a sliding contact with the inner surface 17*a* of the side wall 17, whereas the outer radial surface 19*b* of the spring ring 19 is stationarily affixed to the outer radial surface 3*c* of the base 3*d*. It is also feasible, in the alternative, to attach the spring 19 to the wall 17, in which case the surface 18*a* of the sealing ring 18 contacts the surface 3*c* of the radial base 3*d*.

Figure 3:
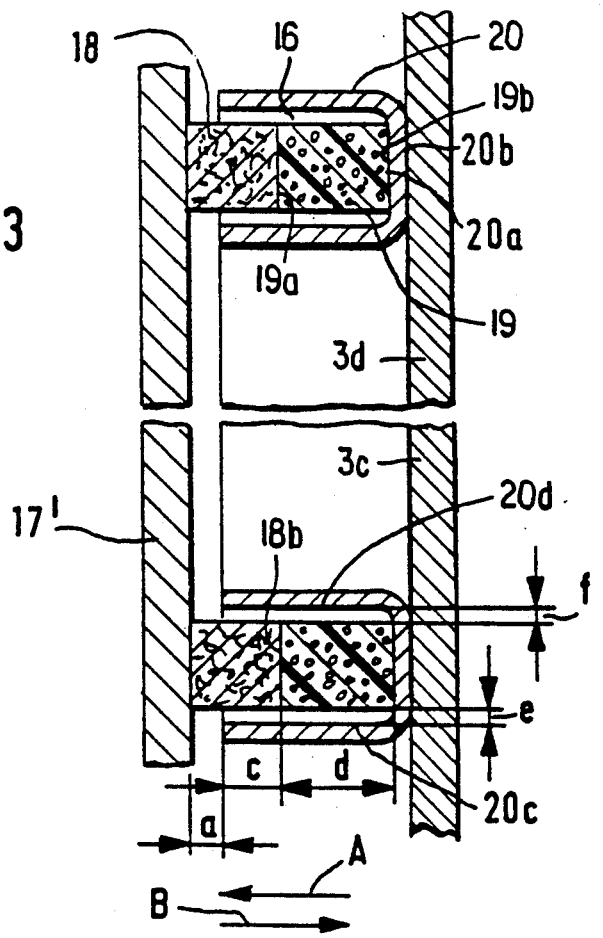
FIG. 3 is a sectional elevational view of another preferred embodiment of the invention.

The embodiment illustrated in FIG. 3 includes a cross-sectionally U-shaped annular housing 20, receiving the two-part seal assembly 16. The sealing ring 18 and the spring ring 19 are supported together in the unilaterally open annular housing 20 by a glue connection between the outer radial surface 19*b* of the spring 19 and the inner bottom face 20*a* of the housing 20. The outer radial face 20*b* of the housing 20 is secured to a radial end face of the roll, such as the outer face 3*c* of the bottom 3*d* shown in FIG. 2. It is feasible, as an alternative, to secure the face 20*b* to the side wall 17. Between the aligned inner circumferential surfaces 18*c* of the sealing ring 18 and 19*c* of the spring ring 19 on the one hand and the adjoining inner circumferential surface 20*c* of the housing 20 a clearance e is provided, whereas between the aligned outer circumferential surfaces 18*d* of the sealing ring 18 and 19*d* of the spring ring 19 and the adjoining inner circumferential surface 20*d* of the housing 20 a clearance f is provided so that the seal assembly 16 is free to move in the direction of the arrows A and B. One part of the sealing ring 18 is displaceable along a length c (for example, 5 mm) between the inner wall faces 20*c* and 20*d*. Thus, the sealing ring 18 is, along length c situated inside the housing 20 whereas the other part thereof (along length a) projects beyond the housing 20. In this manner, the glue bond between the surfaces 18*b* and 19*a* is protected within the housing 20 against rupture by transverse forces, and the sealing ring 18 is reliably guided within the housing 20.

Figure 4:
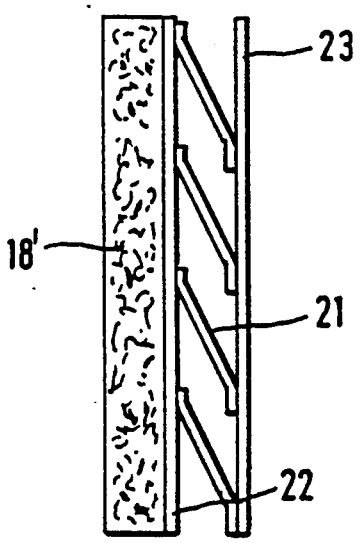
FIG. 4 is an elevational view of yet a further embodiment of the invention.

Turning to the embodiment illustrated in FIG. 4, the linear sealing element 18', on its face opposite from the sealing face, is covered by a flat intermediate component 22 which is engaged by a plurality of leaf springs 21 which have soft spring characteristics and whose respective opposite ends are secured to a stationary surface 23.

Figure 5:
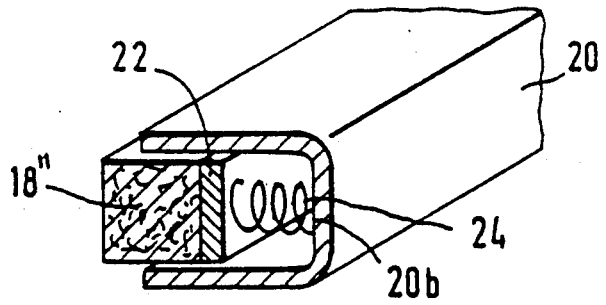
FIGS. 5, 6 and 7 are perspective sectional views of three further preferred embodiments of the invention.

FIG. 5 shows an embodiment which is similar in structure to the FIG. 3 embodiment except that the sealing element 18" and the housing 20' are of linear design, and the spring force is supplied by a series of spaced coil springs 24 (only one shown) situated between a backing strip 22 attached to a rear face of the sealing member 18" and the bottom face 20*b*' of the housing 20'.

Figure 6:
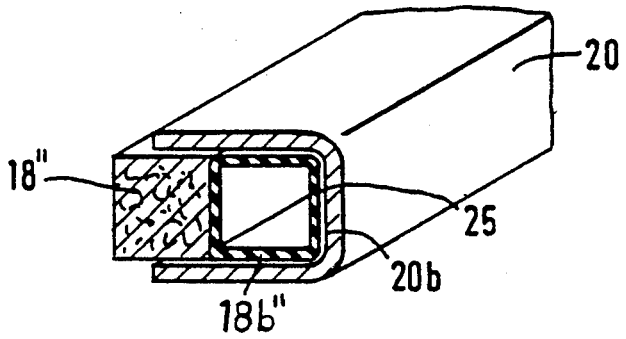

A variant of the embodiment of FIG. 5 is illustrated in FIG. 6, wherein the spring element is a hollow rubber spring 25 of rectangular cross section, whose one surface contacts the rear face 18*b*" of the sealing member 18" and whose opposite face contacts the bottom face 20*b*' of the housing 20'. The rubber spring 25 is filled with air and is compressible. As an alternative, it is feasible to use a solid rubber spring.

It will be understood that the linear constructions of FIGS. 4, 5 and 6 may be of annular design, similarly to the embodiment shown in FIG. 3.

Figure 7:
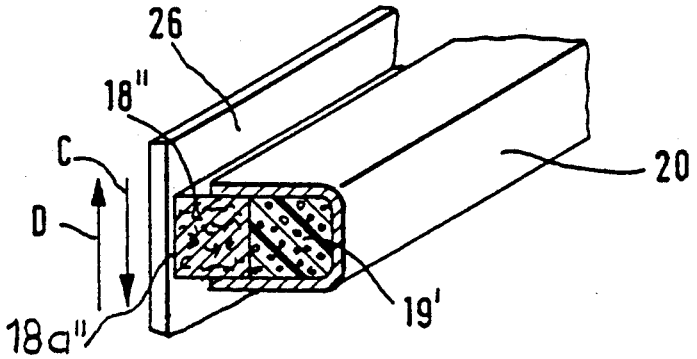

The embodiment shown in FIG. 7 is a linear variant of the annular structure of FIG. 3. The spring element is a bar-like foam rubber element 19'. The surface 18*a*" of the sealing element 18" sealingly contacts a planar surface of a planar component 26 movable in the direction of arrows C and D.

Figure 8:
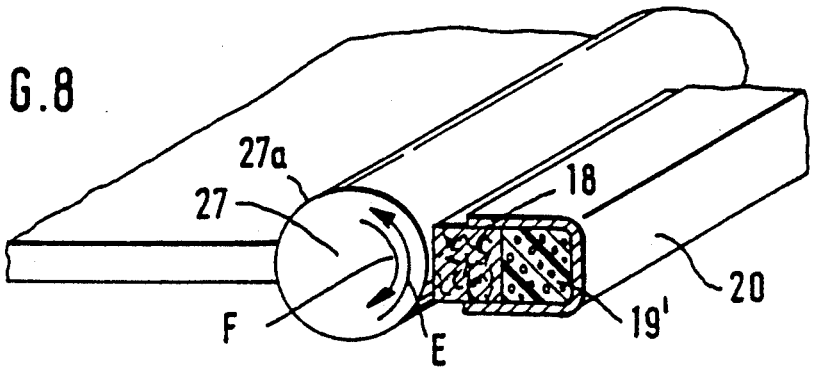
FIG. 8 is a perspective view illustrating the embodiment of FIG. 7 for a use different from that shown in FIG. 7.

In FIG. 8, there is shown the embodiment structured according to FIG. 7 cooperating with a cylindrical surface 27*a* of a joint 27 rotatable in the direction of arrows E and F.

While the invention was described for use with a licker-in 3 of a carding machine, it is to be understood that the seal assembly may also find application in any relatively movable components such as rotary members of fiber cleaning machines, fiber feeders or other fiber processing apparatus.

It will be understood that the above description of the present invention is susceptible to various modifications, changes and adaptations, and the same are intended to be comprehended within the meaning and range of equivalents of the appended claims.

What is claimed is:

1. In a fiber processing machine including a rotary fiber processing roll having a substantially radial end face; a stationary machine wall component having a wall surface facing said radial end face and being at a clearance therefrom; and a seal unit situated in said clearance for providing a seal between the wall surface and the radial end face; the improvement in said seal unit comprising (a) an annular, low-friction, wear-resistant sealing element made of felt and having a sealing face and a reverse face opposite the sealing face; the sealing element projecting axially beyond said radial end face; and (b) a spring made of an annulus of axially resiliently compressible plastic material and having a soft spring characteristic and being in a face-to-face, force-transmitting engagement with said reverse face.

2. A fiber processing machine as defined in claim 1, further wherein said reverse face of said sealing element is bonded to said spring.

3. A fiber processing machine as defined in claim 1, further comprising a housing having an open side; said sealing element and said spring forming a seal assembly received in said housing.

4. A fiber processing machine as defined in claim 3, wherein said housing has a bottom situated opposite said open side; said spring being in engagement with said bottom.

5. A fiber processing machine as defined in claim 4, wherein said housing has a U-shaped cross section.

6. A fiber processing machine as defined in claim 1, wherein said spring is secured to said radial end face of said fiber processing roll and further wherein said sealing face of said sealing element is in engagement with said wall surface.

7. A fiber processing machine as defined in claim 1, wherein said fiber processing roll has an outer diametral zone; and further wherein said sealing element extends along said outer diametral zone.

8. A fiber processing machine as defined in claim 1, wherein said sealing unit further comprises an annular housing having an open radial side; further wherein said sealing element is, together with said spring, received in said housing; said housing having a radial bottom situated opposite said open side; said bottom having an outer face secured to said end face.

9. A fiber processing machine as defined in claim 8, wherein said sealing element projects at least partially from said housing through the open side thereof.

10. A fiber processing machine as defined in claim 8, wherein said housing has inner circumferential wall faces situated at a clearance from said sealing element; said sealing element being supported for movement in an axial path between said circumferential wall faces of said housing.

11. A fiber processing machine as defined in claim 10, wherein the axial path has a length of about 4–6 mm.

* * * * *